United States Patent [19]

Aldridge

[11] Patent Number: 4,629,186

[45] Date of Patent: Dec. 16, 1986

[54] SPRING EXERCISE DEVICE

[76] Inventor: Silas B. Aldridge, P.O. Box 1207, Live Oak, Fla. 32060

[21] Appl. No.: 724,601

[22] Filed: Apr. 16, 1985

[51] Int. Cl.[4] ..... A63B 21/02

[52] U.S. Cl. ..... 272/135; 272/137; 272/68

[58] Field of Search ..... 272/137, 140, 135, 143, 272/93, 130, 68, 67, 141, 142, 136; 128/346, 321, 325, 25 R

[56] References Cited

U.S. PATENT DOCUMENTS

| | | | |
|---|---|---|---|
| 2,529,347 | 11/1950 | Mohler et al. | 272/137 |
| 2,911,859 | 11/1959 | Longley et al. | 411/342 |
| 3,398,746 | 8/1968 | Abramson | 128/321 X |
| 4,210,323 | 7/1980 | Feather | 272/137 |
| 4,332,380 | 6/1982 | Cardin | 272/137 |
| 4,440,170 | 4/1984 | Golden et al. | 128/325 |
| 4,483,533 | 11/1984 | Mangiapane | 272/137 |

FOREIGN PATENT DOCUMENTS 39613 11/1907 Switzerland .

OTHER PUBLICATIONS

The GRP Gripper, AMF, Whitley, 1980.

*Primary Examiner*—Richard J. Apley
*Assistant Examiner*—John L. Welsh
*Attorney, Agent, or Firm*—Harvey B. Jacobson

[57] ABSTRACT

A resistance-type exerciser has pivotally interconnected arms with a more closely spaced pair of handle forming ends and a less closely spaced pair of handle forming ends. A caliper-type spring unit is replaceably fitted to the arms to urge the less closely spaced pair of ends apart. The spring unit can be readily replaced with another unit of different spring pressure so as to vary the resistance of the exerciser. The exerciser is used by pushing the less closely spaced ends toward one another against the spring pressure or by pulling the more closely spaced ends apart.

18 Claims, 14 Drawing Figures

FIG. 7
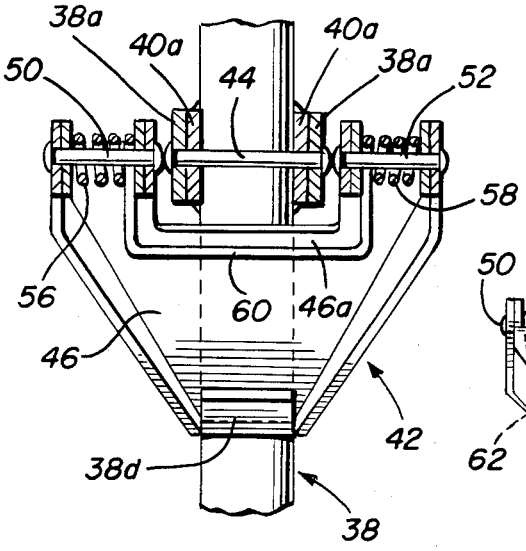
FIG. 8
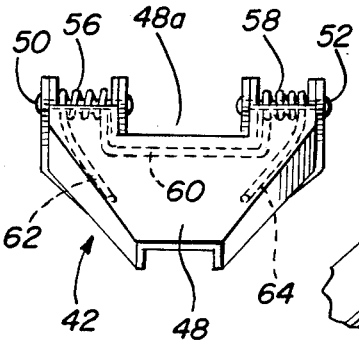
FIG. 9
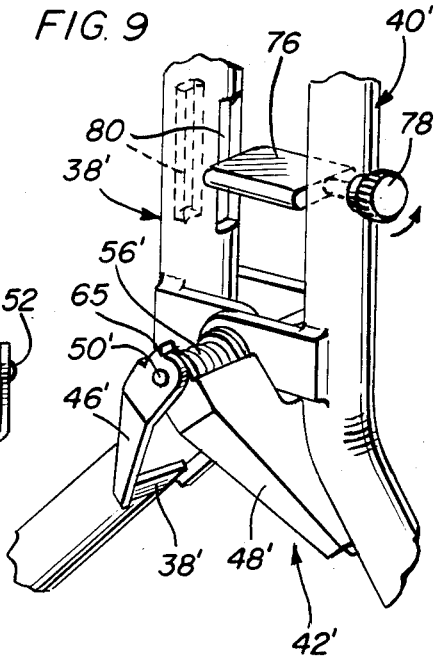
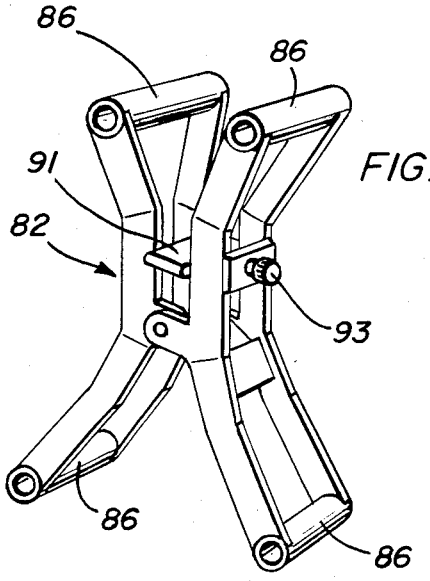
FIG. 10
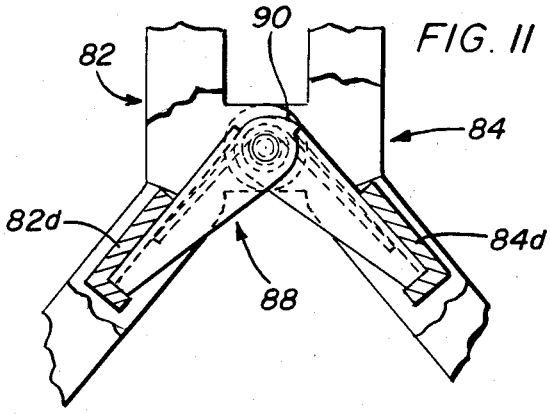
FIG. 11
FIG. 12
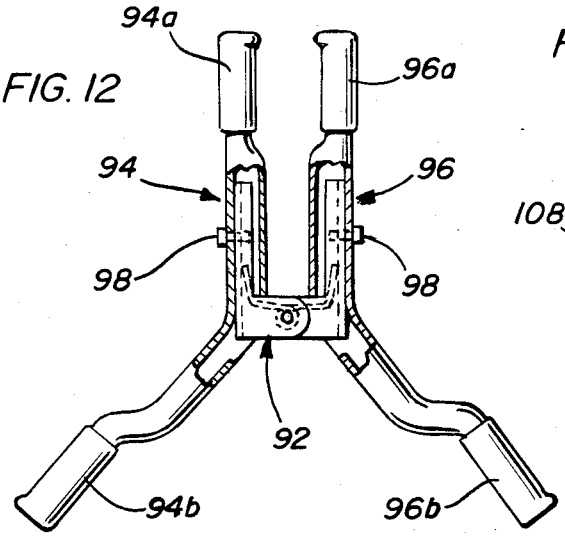
FIG. 14
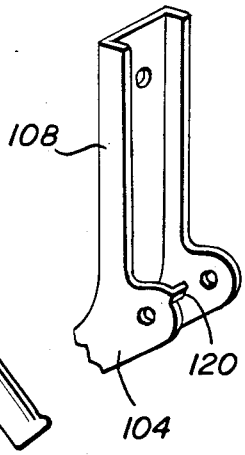
FIG. 13
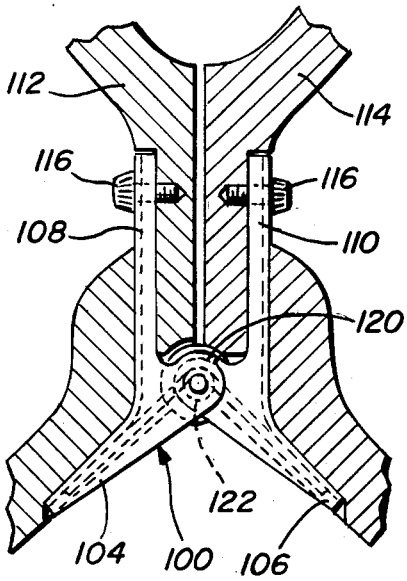

SPRING EXERCISE DEVICE

BACKGROUND OF THE INVENTION

This invention relates to a portable exerciser which can be used by an individual to provide resistance-type exercises for various parts of the body including the hands, wrists, arms, biceps, shoulders, chest/pectoral/-bust area, stomach and back.

It is an object of the invention to provide a novel form of exerciser of the above type which uses a spring unit to provide resistance and which can be used to perform diverse exercises useful for various muscle groups as noted above.

A further object of the invention is to provide an exerciser of the above type in which the spring unit can readily be exchanged for another of different pressure so as to adjust the spring tension of the exerciser.

STATEMENT OF PRIOR ART

Applicant is aware of the following U.S. patents relating to spring exercisers and the like. None of these, however, has the features of the present invention.

U.S. Pat. No. 208,787; Bennstrom-Prescott; 6-20-66
U.S. Pat. No. 2,806,699; Spooner; 12-28-55
U.S. Pat. No. 3,349,621; Mullen; 12-7-64
U.S. Pat. No. 3,497,216; Feather; 3-2-66
U.S. Pat. No. 4,022,463; Scott; 5-10-77
U.S. Pat. No. 4,210,323; Feather; 7-1-80
U.S. Pat. No. 4,465,276; Cox; 8-14-84

SUMMARY OF THE INVENTION

A spring exerciser in accordance with the invention comprises a pair of arms pivotally interconnected at a location substantially intermediate the respective ends, the arms being shaped to provide a pair of more closely spaced ends or hand portions on one side of the pivot and a pair of less closely spaced ends or hand portions on the other side of the pivot, the exerciser further including a spring unit for urging the hand portions defining one of said pair of ends, preferably the less closely spaced pair of ends apart (thereby also urging the other pair of ends toward one another).

To perform exercises, a person may, for example, grasp the less closely spaced pair of ends and push these toward one another against the spring pressure. Alternatively, the person may grasp the more closely spaced pair of ends and pull these apart against the spring pressure.

The spring unit may, for example, comprise a caliper-type assembly including a pair of hinged telescopic channel-section limbs with a hinge pin mounting a coil spring having ends engaging the respective limbs to urge them apart. A removable locking pin may be provided for fitting through the webs of the respective channel-section limbs for holding the limbs together in telescoped relation against the spring action when the unit is not in use. The unit may be received in retaining pockets or the like on the interior surfaces of the respective arms of the exerciser adjacent to pivot point, so that when the locking pin is withdrawn, the spring pressure urges the limbs into contact with the respective pockets, whereby the spring pressure itself is sufficient to retain the spring unit in the pockets without the need for additional fastening means. Further, when the arms of the exerciser are suitably depressed, so as to close the limbs of the spring unit one into the other, the locking pin may be replaced and the entire spring unit removed from the exerciser. It may thus readily be replaced with a similar unit having a spring of different tension whereby the tension of the exerciser may be altered by exchanging spring units.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is an enlarged sectional view on line 7—7 of FIG. 5.

FIG. 8 is an elevational view of a spring device for use in the second form of exerciser.

FIG. 9 is a perspective view of a central portion of the second form of exerciser showing a different type of bumper.

FIG. 10 is a perspective view of a third form of spring exerciser in accordance with the invention.

FIG. 11 is an enlarged sectional elevation of a central portion of the exerciser shown in FIG. 10 showing a removable spring unit.

FIG. 12 is an elevational view of a further spring exerciser in accordance with the invention.

FIG. 13 is an elevational view, part broken away, of a central portion of still another form of spring exerciser in accordance with the invention.

FIG. 14 is a perspective view of part of a spring unit used in the exerciser shown in FIG. 13.

DESCRIPTION OF PREFERRED EMBODIMENT

Referring initially to FIGS. 1 to 4, there is illustrated a first form of spring exerciser 10 in accordance with the invention comprising a pair of lever-like arms 12, 14 and a spring unit 16. The arms may be made in any suitable material, for example wood or plastic, and may be pivotally interconnected intermediate their ends by rivets 17 or the like which fit in hub portions **12*a*, 14*a* of the respective arms. Arms 12, 14 are shaped to provide a pair of more closely spaced end or handle portions 12*b*, 14*b*, and a pair of less closely spaced end or handle portions 12*c*, 14*c***. The respective handle portions may be provided with intergrally formed or with separate slip on hand grips.

In a manner yet to be described, spring unit 16 is adapted to urge the less closely spaced handle portions **12*c*, 14*c* outwardly away from one another and the more closely spaced handle portions 12*b*, 14*b* toward one another. To perform resistance-type exercises, a user may therefore, for example, grip handle portions 12*c*, 14*c* and push them toward one another against the spring pressure or alternatively may grip handle portions 12***b*, 14*b* and pull them apart against the spring pressure.

Figure 1:
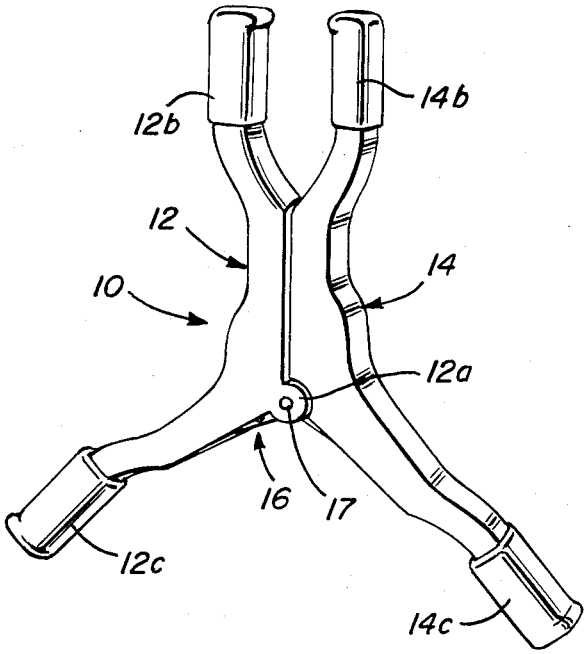
FIG. 1 is a prespective view of a first form of spring exerciser in accordance with the invention.
Figure 2:
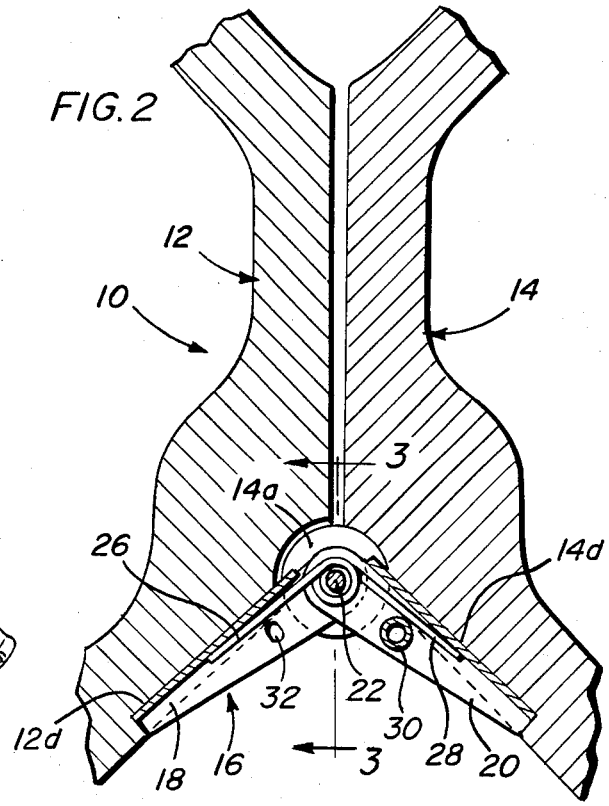
FIG. 2 is an enlarged sectional view of a central portion of the exerciser.
Figure 3:
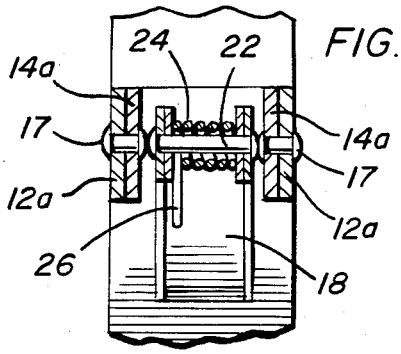
FIG. 3 is a sectional view on line 3—3 of FIG. 2.
Figure 4:
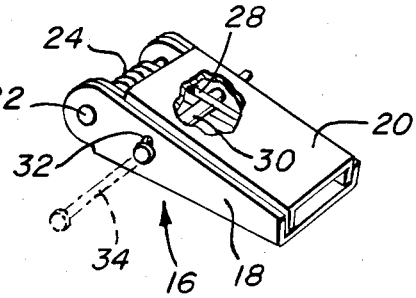
FIG. 4 is a perspective view of a spring unit for use in the exerciser.

Spring unit 16 comprises caliper-type channel section limbs 18, 20 pivotally interconnected by a pin 22 around which is located a coil spring 24 with arms 26, 28 which urge limbs 18, 20 apart. The limbs can, however, be telescoped one within the other by depressing them against the spring pressure. Further, a tube or sleeve 30 extends between the webs of limb 20 and aligned slots 32 are formed in the webs of limb 18, so that when aligned with the tube upon depression of the limbs, a locking pin 34 can be inserted through the entire unit to retain it in closed condition as shown in FIG. 4. Slight further depression of the limbs is permitted within the extent of slots 32, to allow for removal of the locking pin.

The limbs 18, 20 of spring unit 16 fit in respective pockets 12*d*, 14*d* formed on the inner surfaces of arms 12, 14 adjacent the pivot hubs 12*a*, 14*a*, the pockets closely conforming in shape to the shape of the limbs so that when inserted, pivot pin 22 of the spring unit 16 is substantially coaxial with rivets 17. To insert the spring unit into the exerciser, the unit in the depressed condition has one limb inserted in one of the arm pockets and the other arm is then closed on to the unit. Slight further depression by the other arm of the unit then allows locking pin 34 to be removed or fall away. When pressure on arms 12, 14 is released, the spring force presses the limbs 18, 20 of the spring unit into engagement in the arms pockets, so that no external fastening means is required for the spring unit. The unit can be removed by again closing the arms 12, 14 against the spring force until sleeve 30 aligns with slots 32 to allow insertion of locking pin 34, and when the arms are again opened, the spring unit can be removed. It will be understood that a spring unit can thus readily be replaced by another one having a different spring pressure, if the resistance of the exerciser is to be altered. The exerciser may be provided with a bumper mechanism to be described later.

Referring now to FIGS. 5 to 8, there is shown a second form of exerciser 36 in accordance with the invention comprising pivotally interconnected arms 38, 40 and a spring unit 42. The arms may, in this case, be of tubular metal construction, and may be pivotally interconnected intermediate their ends by a pivot pin 44 fitting through pairs of inwardly extending lugs 38*a*, 40*a* on the respective arms. Again, the arms are shaped to have more closely spaced handle forming ends 38*b*, 40*b* and less closely spaced handle forming ends 38*c*, 40*c* with the spring unit 42 being adapted to urge the less closely spaced ends 38*c*, 40*c* outwardly, so that the exerciser may be used in similar manner to that previously described.

Spring unit 42 is generally similar in character to the one previously described comprising channel-section telescopic limbs 46, 48. In this case, however, the limbs have cut out portions 46*a*, 48*a* at their wider ends to accomodate the pivot connection between arms 38, 40, and the limbs are pivotally inconnected by pivot pins 50, 52. A spring with opposed coils 56, 58 surrounding the pins 50, 52, a central U-shaped arm 60 and outer arms 62, 64 urges limbs 46, 48 apart. As in the previous embodiment, spring unit 42 is located substantially at the pivot point of arms 38, 40, with pins 50, 52 substantially coaxial with pin 44. The limbs 46, 48 of the spring unit are located in pockets defined by plates 38*d*, 40*d* on the inside of arms 38, 40 for removal and replacement as in the previous embodiment. The spring unit also has a stop formation 65 on one of the limbs which engages the other limb to limit the degree of opening of the unit. It is also possible for both limbs to have a stop.

Figure 5:
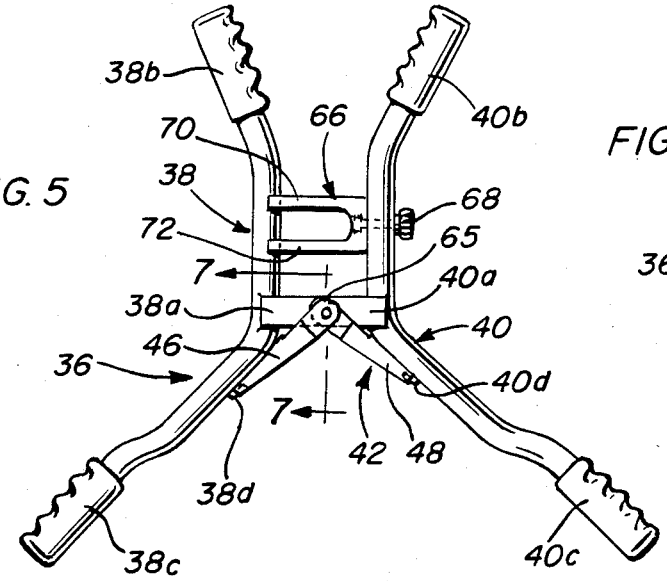
FIG. 5 is an elevational view of a second form of spring exerciser in accordance with the invention.
Figure 6:
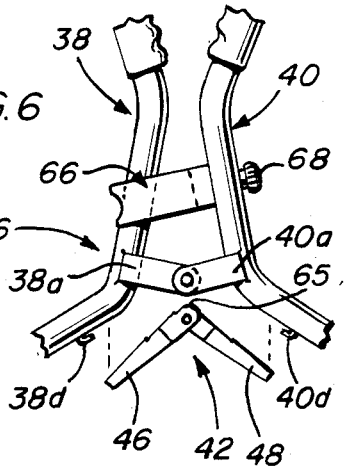
FIG. 6 is a view similar to FIG. 5 of a central portion of the second form of exerciser upon release of a bumper-type stop.

Also, as shown in FIGS. 5 and 6, the exerciser may be provided with a bumper 66 which is rotatably mounted on arm 40 by a pin 68, and which has fingers 70, 72 that engage arm 38 to maintain tension on spring 54 and prevent the lower ends of arms 38, 40 from spreading to a greater extent than allowed by the bumper, until the bumper is rotated through 90 degrees, as shown in FIG. 6, whereby arm 38 can enter between fingers 70, 72. This allows the lower ends of arms 38, 40 to spread to a greater extent than the limbs 46, 48 of the spring unit can spread due to the presence of stop 65, so that the spring unit can be removed from or drop out of the arms for replacement.

A similar form of bumper is shown in FIG. 9 comprising a plate 76 rotatably carried on arm 40' by a pin 78 for selective engagement against arm 38' to prevent spreading of the spring unit 42', or receipt in slots 80 formed through arm 38' to allow for opening of the exerciser.

FIGS. 10 and 11 show another form of exerciser according to the invention operable in similar manner to those previously described and comprising bifurcated pivotally interconnected arms 82, 84 with cross bar-type handles 86 at the respective ends, and a central caliper-type spring unit 88 (similar to unit 42) fitting in pockets 82*d*, 84*d* of the respective arms and being retained therein wholly by the spring force, for urging the less closely-spaced handle-defining ends of arms 82, 84 apart. Further, spring unit 88 includes a stop 90 on one of the spring limbs for engaging the other limb when the unit is spread by a certain amount, thereby forming a stop precluding further spreading of the spring limbs in like manner and for a like purpose to the stop 65. The exerciser also has a bumper 91 on a pin 93 for the same purpose as bumpers 66 and 76.

FIG. 12 shows a somewhat different form of U-shaped caliper-type spring unit 92 fitting in channels formed in exercise arms 94, 96 and being releasably held in place by screws 98. Spring unit 92 may work in the opposite sense to those previously described by having its respective limbs urged toward one another rather than being urged apart, so as to urge the more closely spaced handle forming ends 94*a*, 96*a* of the arms toward one another. The spring unit may have a stop similar to tab 90 for limiting the extent to which its limbs may close on one another. In this arrangement, the arms themselves are separate and the spring unit forms a pivotal connection therebetween. A similar arrangement is shown in FIGS. 13 and 14, but in this case spring unit 100 is of cruciform shape with coil spring 102 acting to urge limbs 104, 106 of the spring unit apart, and with limbs 108, 110 of the unit being secured on the outside of arms 112, 114 of the exerciser by screws 116. In this case, arms 112, 114 are again separate and the spring unit forms a pivotal connection there between. One limb of the spring unit may have a stop tab 120.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A resistance-type exerciser comprising pivotally interconnected arms having a pair of more closely spaced handle forming ends and a pair of less closely spaced handle forming ends and a caliper-type spring unit for replaceable receipt on the arms for urging respective ends of the arms away from one another, the spring unit comprising a pair mating limbs in the form of telescopic channel-section members, pin means pivotally interconnecting the limbs, and a spring connected between the limbs urging the limbs apart, wherein the limbs are receivable in respective pocket means formed on inner surfaces of the respective arms for retention therein through pressure exerted by the spring.

2. The invention of claim 1 wherein the arms have a more closely spaced pair of handle forming ends and a less closely spaced pair of handle forming ends, the arms being pivotally interconnected intermediate the respective pairs of ends.

3. The invention of claim 2 wherein the spring unit is adapted to urge the less closely spaced pair of ends apart.

4. The invention of claim 1 wherein the spring unit and pocket means are relatively configured for locating the pin means substantially coaxially with a pivot connection between the arms.

5. The invention of claim 1 wherein the limbs of the spring unit comprise telescopic channel-section members and the spring unit includes a locking pin for lateral insertion through openings formed in the webs of the respective members to releasably retain the limbs of the spring unit in closed condition counteracting the force of the spring.

6. The invention of claim 1 including a stop element on one of the limbs of the spring unit for engaging the other limb thereof to limit movement of the limbs in the direction of spring pressure.

7. The invention of claim 6 including bumper means associated with one of the arms for limiting closing movements of the more closely spaced pair of ends.

8. In a resistance-type exerciser comprising pivotally interconnected arms having a pair of more closely spaced handle forming ends and a pair of less closely spaced handle forming ends, and spring means urging one of said pair of ends apart and the other of said pair of ends toward one another, the improvement wherein said spring means comprises a caliper-type spring unit detachably associated with said arms, the spring unit having a pair of limbs, a pivot pin pivotally interconnecting the limbs, and a coil spring coaxially received on the pivot pin, the coil spring having extended ends for applying spring pressure on the limbs, the respective limbs of the spring unit being associated with the respective arms of the exerciser for urging the respective pairs of ends of the arms apart and toward one another as aforesaid and the pivot pin of the spring unit being located substantially on a pivot axis of the arms.

9. The invention of claim 1 wherein the arms are separate and the spring unit forms a pivot connection therebetween.

10. The invention of claim 9 wherein the limbs of the spring unit fit in lengthwise channels in the respective arms and the exerciser includes fastener means for releasably securing the limbs in the arms.

11. The invention of claim 1 including means providing a permanent pivotal connection between the arms, and wherein the spring unit is releasably associated with the arms, with said pivot pin being disposed substantially coaxially and adjacent to said pivotal connection.

12. The invention of claim 11 wherein the limbs of the spring unit locate in respective pocket means on inner surfaces of the respective arms for retention therein by pressure exerted by the spring.

13. The invention of claim 12 wherein the limbs comprise telescopic channel-section members urged apart by the spring and wherein the unit incudes a locking pin for insertion latterally through respective openings in the webs of said members for retaining the limbs in closed telescoped condition counteracting the force of the spring.

14. The invention of claim 11 wherein the spring unit is adapted to urge the less closely spaced ends of the arms apart.

15. A resistance-type exerciser comprising a pair of arms, means forming a pivotal connection between the arms intermediate the ends thereof with the arms shaped to provide a pair of more closely spaced handle forming ends and a pair of less closely spaced handle forming ends, and spring means associated with the arms for urging the less closely spaced ends apart and the more closely spaced ends toward one another, wherein the spring means comprises a caliper-type spring unit detachably associated with the exerciser, the spring unit having pivotally interconnected limbs associated with the respective arms and a spring for exerting pressure on the respective limbs effective for urging the opposite ends of the arms respectively apart and toward one another as aforesaid, wherein the limbs of the spring unit comprise mating telescopic channel-section members, and the unit includes a locking pin for insertion laterally through openings in the webs of the respective limbs for releasably retaining the limbs in closed telescoped position counteracting the force of the spring.

16. The invention of claim 15 wherein the limbs of the spring unit are received in pocket means provided on interior surfaces of the respective arms and retained therein by the force of the spring.

17. The invention of claim 15 wherein the limbs of the spring unit are provided with a stop for limiting the amount they be may be opened by the spring.

18. The invention of claim 15 including adjustable bumper means operable between the arms for selectively limiting the amount by which the respective ends of the arms can move toward and away from one another as aforesaid, the less closely spaced arms being capable of spreading to an extent greater than the limbs of the spring unit whereby the spring unit can be removed when the bumper means is inoperative.

* * * * *